US005085798A

United States Patent [19]

Swan et al.

[11] Patent Number: 5,085,798

[45] Date of Patent: Feb. 4, 1992

[54] AZEOTROPE-LIKE COMPOSITIONS OF 1,1-DICHLORO-1-FLUOROETHANE, CYCLOPENTANE AND OPTIONALLY AN ALKANOL

[75] Inventors: Ellen L. Swan, Ransomville; Rajat S. Basu, Williamsville; Richard M. Hollister, Buffalo, all of N.Y.

[73] Assignee: Allied-Signal Inc., Morris Township, Morris County, N.J.

[21] Appl. No.: 580,897

[22] Filed: Sep. 11, 1990

[51] Int. Cl.[5] ..... C11D 7/30; C11D 7/50; C23G 5/028; B08B 3/00

[52] U.S. Cl. ..... 252/171; 134/12; 134/31; 134/38; 134/39; 134/40; 252/153; 252/162; 252/170; 252/172; 252/364; 252/DIG. 9

[58] Field of Search ..... 252/162, 170, 171, 172, 252/364, DIG. 9, 153; 134/12, 31, 38, 39, 40

[56] References Cited

U.S. PATENT DOCUMENTS

| | | | |
|---|---|---|---|
| 4,795,763 | 1/1989 | Gluck et al. | 521/99 |
| 4,836,947 | 6/1989 | Lind et al. | 252/171 |
| 4,842,764 | 6/1989 | Lund et al. | 252/171 |
| 4,994,201 | 2/1991 | Stachura et al. | 252/171 |
| 5,026,502 | 6/1991 | Cogsdon et al. | 252/172 |
| 5,039,444 | 8/1991 | Lund et al. | 252/171 |

FOREIGN PATENT DOCUMENTS

| | | | |
|---|---|---|---|
| 1-132814 | 5/1989 | Japan . | |
| 1-139779 | 6/1989 | Japan | 252/172 |
| 1-139780 | 6/1989 | Japan . | |
| 1-141996 | 6/1989 | Japan . | |
| 1-234432 | 9/1989 | Japan . | |
| 2-214800 | 8/1990 | Japan . | |

OTHER PUBLICATIONS

Research Disclosure No. 16265, vol. 162, Oct. 1977.

Application Ser. No. 361,512 to E. A. E. Lund et al., filed Jun. 5, 1989, a continuation of Ser. No. 204,340 filed 6/9/88.

Application Ser. No. 189,932, to E. A. E. Lund et al., filed May 3, 1988.

*Primary Examiner*—Paul Lieberman
*Assistant Examiner*—Linda D. Skaling
*Attorney, Agent, or Firm*—Colleen D. Szuch; Jay P. Friedenson

[57] ABSTRACT

Stable azeotrope-like compositions consisting essentially of 1,1-dichloro-1-fluoroethane, cyclopentane and optionally an alkanol which are useful in a variety of industrial cleaning applications including cold cleaning and defluxing of printed circuit boards.

19 Claims, No Drawings

AZEOTROPE-LIKE COMPOSITIONS OF 1,1-DICHLORO-1-FLUOROETHANE, CYCLOPENTANE AND OPTIONALLY AN ALKANOL

FIELD OF THE INVENTION

This invention relates to azeotrope-like compositions containing 1,1-dichloro-1-fluoroethane, cyclopentane and optionally an alkanol. These mixtures are useful in a variety of vapor degreasing, cold cleaning and solvent cleaning applications including defluxing.

BACKGROUND OF THE INVENTION

Fluorocarbon based solvents have been used extensively for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent leaves the object free of residue. This is contrasted with liquid solvents which leave deposits on the object after rinsing.

A vapor degreaser is used for difficult to remove soils where elevated temperature is necessary to improve the cleaning action of the solvent, or for large volume assembly line operations where the cleaning of metal parts and assemblies must be done efficiently. The conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al., in U.S. Pat. No. 3,085,918 disclose such suitable vapor decreasers comprising a boiling sump, a clean sump, a water separator, and other ancillary equipment.

Cold cleaning is another application where a number of solvents are used. In most cold cleaning applications, the soiled part is either immersed in the fluid or wiped with cloths soaked in solvents and allowed to air dry.

Recently, nontoxic nonflammable fluorocarbon solvents like trichlorotrifluoroethane have been used extensively in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions having fluorocarbon components because the fluorocarbon components contribute additionally desired characteristics, such as polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse-cleaning Thus, the vapor degreasing system acts as a still. Therefore, unless the solvent composition is essentially constant boiling, fractionation will occur and undesirable solvent distribution may act to upset the cleaning and safety of processing. For example, preferential evaporation of the more volatile components of the solvent mixtures, would result in mixtures with changed compositions which may have less desirable properties, like lower solvency towards soils, less inertness towards metal, plastic or elastomer components, and increased flammability and toxicity.

The art is continually seeking new fluorocarbon based azeotrope mixtures or azeotrope-like mixtures which offer alternatives for new and special applications for vapor degreasing and other cleaning applications. Currently, fluorocarbon based azeotrope-like mixtures are of particular interest because they are considered to be stratospherically safe substitutes for presently used fully halogenated chlorofluorocarbons. The latter have been implicated in causing environmental problems associated with the depletion of the earth's protective ozone layer. Mathematical models have substantiated that hydrochlorofluorocarbons, like 1,1-dichloro-1-fluoroethane (HCFC-141b) have a much lower ozone depletion potential and global warming potential than the fully halogenated species.

Accordingly, it is an object of the invention to provide novel environmentally acceptable azeotropic compositions useful in a variety of industrial cleaning applications.

It is another object of the invention to provide azeotrope-like compositions which are liquid at room temperature and which will not fractionate under conditions of use.

Other objects and advantages of the invention will become apparent from the following description.

SUMMARY OF THE INVENTION

The invention relates to novel azeotrope-like compositions which are useful in a variety of industrial cleaning applications. Specifically, the invention relates to compositions based on 1,1-dichloro-1-fluoroethane, cyclopentane and optionally an alkanol which are essentially constant boiling, environmentally acceptable, non-fractionating, and which remain liquid at room temperature.

DETAILED DESCRIPTION OF THE INVENTION

In accordance with the invention, novel azeotrope-like compositions have been discovered comprising from about 86 to about 99.99 weight percent 1,1-dichloro-1-fluoroethane (HCFC-141b), from about 0.01 to about 10.5 weight percent cyclopentane and optionally from about 0 to about 4 weight percent alkanol which boil at about 30.8° C. ± about 1.3° C. at 760 mm Hg.

Azeotrope-like compositions consisting essentially of from about 93.9 to about 99.99 weight percent HCFC-141b and from about 0.01 to about 6.1 weight percent cyclopentane which boil at about 32.2° C. ± about 0.3° C. at 760 mm Hg.

In a preferred embodiment, the azeotrope-like compositions of the invention consist essentially of from about 97 to about 99.99 weight percent HCFC-141b and from about 0.01 to about 3 weight percent cyclopentane.

When methanol is added, the azeotrope-like compositions of the invention consist essentially of from about 85.5 to about 98.99 weight percent HCFC-141b, from about 1 to about 4 weight percent methanol and from about 0.01 to about 10.5 weight percent cyclopentane and boil at about 29.7° C. ± about 0.5° C. at 760 mm Hg.

In a preferred embodiment utilizing methanol, the azeotrope-like compositions of the invention consist essentially of from about 88.9 to about 99.49 weight percent HCFC-141b, from about 2.5 to about 3.8 weight percent methanol and from about 0.01 to about 4.3 weight Percent cyclopentane.

When the alkanol is ethanol, the azeotrope-like compositions of the invention consist essentially of from about 90 to about 99.94 weight percent HCFC-141b, from about 0.05 to about 2 weight percent ethanol and from about 0.01 to about 8 weight percent cyclopentane and boil at about 31.9° C, ± about 0.3° C. at 760 mm Hg.

In a preferred embodiment utilizing ethanol, the azeotrope-like compositions of the invention consist essentially of from about 95.3 to about 98.99 weight percent HCFC-141b, from about 1 to about 2 weight percent ethanol, and from about 0.01 to about 2.7 weight percent cyclopentane.

The 1,1-dichloro-1-fluoroethane component of the invention has good solvent properties. The alkanol and the alkane components also have good solvent capabilities. The alkanol dissolves polar organic materials and amine hydrochlorides while the alkane enhances the solubility of oils. Thus, when these components are combined in effective amounts an efficient azeotrope-like solvent results.

It is known in the art that the use of more active solvents, such as lower alkanols in combination with certain halocarbons such as trichlorotrifluoroethane, may have the undesirable result of attacking reactive metals such as zinc and aluminum, as well as certain aluminum alloys and chromate coatings such as are commonly employed in circuit board assemblies. The art has recognized that certain stabilizers, like nitromethane, are effective in preventing metal attack by chlorofluorocarbon mixtures with such alkanols. Other candidate stabilizers for this purpose, such as disclosed in the literature, are secondary and tertiary amines, olefins and cycloolefins, alkylene oxides, sulfoxides, sulfones, nitrites and nitriles, and acetylenic alcohols or ethers. It is contemplated that such stabilizers as well as other additives may be combined with the azeotrope-like compositions of this invention.

The precise or true azeotrope compositions have not been determined but have been ascertained to be within the indicated ranges. Regardless of where the true azeotropes lie, all compositions within the indicated ranges, as well as certain compositions outside the indicated ranges, are azeotrope-like, as defined more particularly below.

It has been found that these azeotrope-like compositions are on the whole nonflammable liquids, i.e. exhibit no flash point when tested by the Tag Open Cup test method—ASTM D 1310-86.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated P and T. In practice, this means that the components of a mixture cannot be separated during distillation, and therefore in vapor phase solvent cleaning as described above.

For purposes of this discussion, the term "azeotrope-like composition" is intended to mean that the composition behaves like a true azeotrope in terms of its constant-boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only slightly. This is contrasted with non-azeotrope-like compositions in which the liquid composition changes substantially during boiling or evaporation.

Thus, one way to determine whether a candidate mixture is "azeotrope-like" within the meaning of this invention, is to distill a sample thereof under conditions (i.e. resolution—number of plates) which would be expected to separate the mixture into its components. If the mixture is non-azeotropic or non-azeotrope-like, the mixture will fractionate, with the lowest boiling component distilling off first, etc. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above discussion that another characteristic of azeotrope-like compositions is that there is a range of compositions containing the same components in varying proportions which are azeotrope-like. All such compositions are intended to be covered by the term azeotrope-like as used herein. As an example, it is well known that at different pressures, the composition of a given azeotrope will vary at least slightly as does the boiling point of the composition. Thus, an azeotrope of A and B represents a unique type of relationship but with a variable composition depending on temperature and/or pressure. Accordingly, another way of defining azeotrope-like within the meaning of this invention is to state that such mixtures boil within about ±0.5° C. (at 760 mm Hg) of the boiling point of the most preferred compositions disclosed herein. As is readily understood by persons skilled in the art, the boiling point of the azeotrope will vary with the pressure.

In the process embodiment of the invention, the azeotrope-like compositions of the invention may be used to clean solid surfaces by treating said surfaces with said compositions in any manner well known to the art such as by dipping or spraying or use of conventional degreasing apparatus.

When the present azeotrope-like compositions are used to clean solid surfaces by spraying the surfaces with the compositions, preferably, the azeotrope-like compositions are sprayed onto the surfaces by using a propellant. Preferably, the propellant is selected from the group consisting of hydrocarbons, chlorofluorocarbons, hydrochlorofluorocarbon, hydrofluorocarbon, dimethyl ether, carbon dioxide, nitrogen, nitrous oxide, methylene oxide, air, and mixtures thereof.

Useful hydrocarbon propellants include isobutane, butane, propane, and mixtures thereof; commercially available isobutane, butane, and propane may be used in the present invention. Useful chlorofluorocarbon propellants include trichlorofluoromethnne (known in the art as CFC-11), dichlorodifluoromethane (known in the art as CFC-12), 1,1,2-trichloro-1,2,2-trifluoroethane (known in the art as CFC-113), and 1,2-dichloro-1,1,2,2-tetrafluoroethane (known in the art as CFC-114); commercially available CFC-11, CFC-12, CFC-113, and CFC-114 may be used in the present invention.

Useful hydrochlorofluorocarbon propellants include dichlorofluoromethane (known in the art as HCFC-21), chlorodifluoromethane (known in the art as HCFC-22), 1-chloro-1,2,2,2-tetrafluoroethane (known in the art as HCFC-124), 1,1-dichloro-2,2-difluoroethane (known in the art as HCFC-132a), 1-chloro-2,2,2-trifluoroethane (known in the art as HCFC-133), and 1-chloro-1,1-difluoroethane (known in the art as HCFC-142b); commercially available HCFC-21, HCFC-22, and HCFC-142b may be used in the present invention. HCFC-124 may be prepared by a known process such as that taught by U.S Pat. No. 4,843,181 and HCFC-133 may be prepared by a known process such as that taught by U.S. Pat. No. 3,003,003.

Useful hydrofluorocarbon propellants include trifluoromethane (known in the art as HFC-23), 1,1,1,2-tetrafluoroethane (known in the art as HFC-134a), and 1,1-difluoroethane (known in the art as HFC-152a); commercially available HFC-23 and HFC-152a may be used in the present invention. Until HFC-134a becomes available in commercial quantities, HFC-134a may be prepared by any known method such as that disclosed by U.S. Pat. No. 4,851,595. More preferred propellants include hydrochlorofluorocarbons, hydrofluorocarbons, and mixtures thereof. The most preferred propellants include chlorodifluoromethane and 1,1,1,2-tetrafluoroethane.

The HCFC-141b, cyclopentane and alkanol components of the invention are known materials. Preferably they should be used in sufficiently high purity so as to avoid the introduction of adverse influences upon the solvency properties or constant-boiling properties of the system.

It should be understood that the present compositions may include additional components so as to form new azeotrope-like or constant-boiling compositions. Any such compositions are considered to be within the scope of the present invention as long as the compositions are constant-boiling or essentially constant-boiling and contain all of the essential components described herein.

The present invention is more fully illustrated by the following non-limiting Examples.

EXAMPLE 1

The compositional range over which 141b and cyclopentane (CP) exhibit constant-boiling behavior was determined. This was accomplished by charging approximately 8 ml. 141b into an ebulliometer, bringing it to a boil, adding measured amounts of cyclopentane and finally recording the temperature of the ensuing boiling mixture. The boiling point versus composition curve indicated that a constant boiling composition formed.

The ebulliometer consisted of a heated sump in which the 141b was brought to a boil. The upper part of the ebulliometer connected to the sump was cooled thereby acting as a condenser for the boiling vapors, allowing the system to operate at total reflux. After bringing the 141b to a boil at atmospheric pressure, measured amounts of cyclopentane were titrated into the ebulliometer. The change in boiling point was measured with a platinum resistance thermometer.

The following table lists, for Example 1, the compositional range over which the 141b/cyclopentane mixture is constant boiling; i.e. the boiling point deviations are within ± about 0.5° C. of each other. Based on the data in Table I, 141b/cyclopentane compositions ranging from about 93.91–99.99/0.01–6.09 weight percent respectively would exhibit constant boiling behavior.

TABLE I

| Composition (wt. %) | | Temperature |
|---|---|---|
| 141b | CP | (°C. @ 760 mm Hg) |
| 100.0 | 0.00 | 32.04 |
| 99.94 | 0.06 | 32.03 |
| 99.82 | 0.18 | 32.03 |
| 99.52 | 0.48 | 32.05 |
| 98.93 | 1.07 | 32.07 |
| 98.35 | 1.65 | 32.11 |
| 97.20 | 2.80 | 32.22 |
| 96.07 | 3.92 | 32.32 |
| 93.91 | 6.09 | 32.47 |

EXAMPLE 2

The compositional range over which 141b, cyclopentane (CP) and methanol exhibit constant-boiling behavior was determined. This was accomplished by charging 8 ml. of selected 141b-based binary compositions into an ebulliometer, bringing them to a boil, adding measured amounts of a third component and finally recording the temperature of the ensuing boiling mixture. The boiling point versus composition curve indicated that a constant boiling composition formed.

The ebulliometer consisted of a heated sump in which the 141b-based binary mixture was brought to a boil. The upper part of the ebulliometer connected to the sump was cooled thereby acting as a condenser for the boiling vapors, allowing the system to operate at total reflux. After bringing the 141b-based binary mixture to a boil at atmospheric pressure, measured amounts of a third component were titrated into the ebulliometer. The change in boiling point was measured with a platinum resistance thermometer.

The following table lists, for Example 2, the compositional range over which the 141b/cyclopentane/methanol mixture is constant boiling; i.e. the boiling point deviations are within ±about 0.5° C. of each other. Based on the data in Table II, 141b/cyclopentane/methanol compositions ranging from about 86.11–96.19/0.01–10.54/3.8–3.35 weight percent respectively would exhibit constant boiling behavior.

TABLE II

| Composition (wt. %) | | | Temperature |
|---|---|---|---|
| 141b | CP | MeOH | (°C. @ 760 mm Hg) |
| 96.2 | 0.00 | 3.8 | 29.51 |
| 96.2 | 0.06 | 3.74 | 29.51 |
| 96.08 | 0.18 | 3.73 | 29.51 |
| 95.79 | 0.49 | 3.72 | 29.52 |
| 95.50 | 0.79 | 3.71 | 29.52 |
| 94.93 | 1.38 | 3.69 | 29.54 |
| 94.36 | 1.98 | 3.67 | 29.56 |

TABLE II-continued

| Composition (wt. %) | | | Temperature |
|---|---|---|---|
| 141b | CP | MeOH | (°C. @ 760 mm Hg) |
| 93.24 | 3.13 | 3.62 | 29.63 |
| 92.15 | 4.27 | 3.58 | 29.67 |
| 90.05 | 6.45 | 3.50 | 29.76 |
| 88.03 | 8.54 | 3.42 | 29.86 |
| 86.11 | 10.54 | 3.35 | 29.94 |

EXAMPLE 3

The compositional range over which 141b, cyclopentane (CP) and ethanol exhibit constant-boiling behavior was determined by repeating the experiment outlined in Example 2 above. The boiling point versus composition curve indicated that a constant boiling composition formed.

The following table lists, for Example 3, the compositional range over which the 141b/cyclopentane/ethanol mixture is constant boiling; i.e. the boiling point deviations are within ± about 0.5° C. of each other. Based on the data in Table III, 141b/cyclopentane/ethanol compositions ranging from about 90.08–97.98/0.01–8.07/1.85–2.01 weight percent respectively would exhibit constant boiling behavior.

TABLE III

| Composition (wt. %) | | | Temperature |
|---|---|---|---|
| 141b | CP | EtOH | (°C. @ 760 mm Hg) |
| 97.99 | 0.00 | 2.01 | 31.69 |
| 97.93 | 0.06 | 2.01 | 31.70 |
| 97.81 | 0.18 | 2.01 | 31.70 |
| 97.69 | 0.30 | 2.00 | 31.71 |
| 97.40 | 0.60 | 2.00 | 31.71 |
| 97.10 | 0.90 | 2.00 | 31.72 |
| 96.53 | 1.49 | 1.98 | 31.76 |
| 95.39 | 2.65 | 1.96 | 31.83 |
| 94.28 | 3.78 | 1.94 | 31.91 |
| 92.13 | 5.97 | 1.89 | 32.06 |
| 90.08 | 8.07 | 1.85 | 32.18 |

EXAMPLES 4–6

To illustrate the constant boiling and non-segregating properties of the compositions of the invention under conditions of actual use in vapor phase degreasing operations, a vapor degreasing machine is charged with the azeotrope-like composition of example 1. (The experiment is repeated using the compositions of Examples 2–3.) The vapor phase degreasing machine utilized is a small water-cooled, three-sump vapor phase degreaser. This machine is comparable to machines used in the field today and presents the most rigorous test of solvent segregating behavior. Specifically, the degreaser employed to demonstrate the constant-boiling and non-segregating properties of the invention contains two overflowing rinse-sumps and a boil-sump. The boil-sump is electrically heated and contains a low-level shut-off switch. Solvent vapors in the degreaser are condensed on water-cooled stainless-steel coils. The capacity of the unit is approximately 1.2 gallons. This degreaser is very similar to degreasers which are commonly used in commercial establishments.

The solvent charge is brought to reflux and the compositions in the rinse sump and the boil sump, where the overflow from the work sump is brought to the mixture boiling point, are determined using a Perkin Elmer 8500 gas chromatograph. The temperature of the liquid in the boil sump is monitored with a thermocouple temperature sensing device accurate to ±0.2° C. Refluxing is continued for 48 hours and sump compositions are monitored throughout this time. A mixture is considered constant boiling or non-segragating if the maximum concentration difference between sumps for any mixture component is ±2 sigma around the mean value. Sigma is a standard deviation unit It is our experience based upon many observations of vapor degreaser performance that commercial "azeotrope-like" vapor Phase degreasing solvents exhibit at least a ±2 sigma variation in composition with time and still produce very satisfactory non-segregating cleaning behavior.

If the mixture is not azeotrope-like, the high boiling components will very quickly concentrate in the boil sump and be depleted in the rinse sump. This does not happen with the compositions of the invention. In addition, the concentration of each component in the sumps remains well within ±2 sigma. These results indicate that the compositions of the invention are constant boiling and will not segregate in any large-scale commercial vapor degreasers, thereby avoiding potential safety, performance and handling problems.

EXAMPLE 7–9

Performance studies are conducted to evaluate the solvent properties of the azeotrope-like compositions of the invention. Specifically, metal coupons are cleaned using the azeotrope-like composition of Example 1 as solvent. (The experiment is repeated using the compositions of Examples 2–3) The metal coupons are soiled with various types of oils and heated to 93° C. so as to partially simulate the temperature attained while machining and grinding in the presence of these oils.

The metal coupons thus treated are degreased in a simulated vapor phase degreaser. Condenser coils are kept around the lip of a cylindrical vessel to condense the solvent vapor which then collectes in the vessel. The metal coupons are held in the solvent vapor and rinsed for a period of 15 seconds to 2 minutes depending upon the oils selected. Coupons are held in the solvent vapor and then vapor rinsed for a period of 15 seconds to 2 minutes depending upon the oils selected.

The cleaning performance of the compositions is determined by visual observation and by measuring the weight change of the coupons using an analytical balance to determine the total residual materials left after cleaning. The results indicate that the azeotrope-like compositions of the invention are effective solvents.

EXAMPLES 10–13

For the following examples, six-ounce three-piece aerosol cans are used. The azeotrope-like composition of each of Examples 1–3 is weighed into a tared aerosol can. After purging the can with tetrafluoroethane in order to displace the air within the container, a valve is mechanically crimped onto the can. Liquid chlorodifluoromethane is then added through the valve utilizing pressure burettes.

A printed circuit board having an area of 37.95 square inches and densely populated with dip sockets, resistors, and capacitors is precleaned by rinsing with isopropanol before wave soldering. The board is then fluxed and wave soldered using a Hollis TDL wave solder machine.

The printed circuit board is then spray cleaned using the aerosol can having the azeotrope-like composition therein. The cleanliness of the board is tested visually and also using an Omega-meter which measures the ionic contamination of the board. The results indicate that the azeotrope-like compositions of the invention are effective cleaning solvents.

Having described the invention in detail and by reference to preferred embodiments thereof, it will be apparent that modifications and variations are possible without departing from the scope of the invention defined in the appended claims.

What is claimed is:

1. Azeotrope-like compositions consisting essentially of from about 93.9 to about 99.99 weight percent 1,1-dichloro-1-fluoroethane and from about 0.01 to about 6.1 weight percent cyclopentane which boil at about 32.2° C. at 760 mm Hg; or from about 85.5 to about 98.99 weight percent 1,1-dichloro-1-fluoroethane, from about 1 to about 4 weight percent methanol and from about 0.01 to about 10.5 weight percent cyclopentane which boil at about 29.7° C. at 760 mm Hg; or from about 90 to about 99.94 weight percent 1,1-dichloro-1-fluoroethane, from about 0.05 to about 2 weight percent ethanol and from about 0.01 to about 8 weight percent cyclopentane which boil at about 31.9° C. at 760 mm Hg wherein the azeotrope-like components of the compositions consist of 1,1-dichloro-1-fluoroethane, cyclopentane and optionally methanol or ethanol.

2. The azeotrope-like compositions of claim 1 wherein said compositions of 1,1-dichloro-1-fluoroethane and cyclopentane boil at about 32.2° C.±0.3°60 C. at 760 mm Hg.

3. The azeotrope-like compositions of claim 1 wherein said compositions consist essentially of from about 97 to about 99.99 weight percent 1,1-dichloro-1-fluoroethane and from about 0.01 to about 3 weight percent cyclopentane.

4. The azeotrope-like compositions of claim 1 wherein said compositions of 1,1-dichloro-1-fluoroethane, methanol and cyclopentane boil at about 29.7° C.±0.5° C. at 760 mm Hg.

5. The azeotrope-like compositions of claim 1 wherein said compositions consist essentially of from about 88.9 to about 99.49 weight percent 1,1-dichloro-1-fluoroethane, from about 2.5 to about 3.8 weight percent methanol and from about 0.01 to about 4.3 weight percent cyclopentane.

6. The azeotrope-like compositions of claim 1 wherein said compositions of 1,1-dichloro-1-fluoroethane, ethanol and cyclopentane boil at about 31.9° C.±0.3° C. at 760 mm Hg.

7. The azeotrope-like compositions of claim 1 wherein said compositions consist essentially of from about 95.3 to about 98.99 weight percent 1,1-dichloro-1-fluoroethane, from about 1 to about 2 weight percent ethanol and from about 0.01 to about 2.7 weight percent cyclopentane.

8. The azeotrope-like compositions of claim 1 wherein an effective amount of a stabilizer is present in said compositions to prevent metal attack.

9. The azeotrope-like compositions of claim 3 wherein an effective amount of a stabilizer is present in said compositions to prevent metal attack.

10. The azeotrope-like compositions of claim 5 wherein an effective amount of a stabilizer is present in said compositions to prevent metal attack.

11. The azeotrope-like composition of claim 7 wherein an effective amount of stabilizer is present in said compositions to prevent metal attack.

12. The azeotrope-like compositions of claim 8 wherein said stabilizer is selected from the group consisting of nitromethane, secondary and tertiary amines, olefins, cycloolefins, alkylene oxides, sulfoxides, sulfones, nitrites, nitriles, acetylenic alcohols or ethers.

13. The azeotrope-like compositions of claim 9 wherein said stabilizer is selected from the group consisting of nitromethane, secondary and tertiary amines, olefins, cycloolefins, alkylene oxides, sulfoxides, sulfones, nitrites, nitriles, acetylenic alcohols or ethers

14. The azeotrope-like compositions of claim 10 wherein said stabilizer is selected from the group consisting of nitromethane, secondary and tertiary amines, olefins, cycloolefins, alkylene oxides, sulfoxides, sulfones, nitrites, nitriles, acetylenic alcohols or ethers.

15. The azeotrope-like compositions of claim 11 wherein said stabilizer is selected from the group consisting of nitromethane, secondary and tertiary amines, olefins, cycloolefins, alkylene oxides, sulfoxides, sulfones, nitrites, nitriles, acetylenic alcohols or ethers.

16. A method of cleaning a solid surface comprising treating said surface with an azeotrope-like composition of claim 1.

17. A method of cleaning a solid surface comprising treating said surface with an azeotrope-like composition of claim 3.

18. A method of cleaning a solid surface comprising treating said surface with an azeotrope-like composition of claim 5.

19. A method of cleaning a solid surface comprising treating said surface with an azeotrope-like composition of claim 7.

* * * * *

UNITED STATES PATENT AND TRADEMARK OFFICE

CERTIFICATE OF CORRECTION

PATENT NO. : 5,085,798

DATED : February 4, 1992

INVENTOR(S) : Ellen L. Swan, Rajat S. Basu and Richard M. Hollister

It is certified that error appears in the above-identified patent and that said Letters Patent is hereby corrected as shown below:

Please amend column 9, lines 26 - 29 as follows:

2. The azeotrope-like compositions of claim 1 wherein said compositions of 1,1-dichloro-1-fluoroethane and cyclopentane boil at about 32.2°C. ± 0.3°[60] C. at 760 mm Hg.

Signed and Sealed this

Thirty-first Day of August, 1993

*Attest:*

*Attesting Officer*

Bruce Lehman

BRUCE LEHMAN

*Commissioner of Patents and Trademarks*